US006102789A

United States Patent [19]

Ramanath et al.

[11] Patent Number: 6,102,789

[45] **Date of Patent: *Aug. 15, 2000**

[54] ABRASIVE TOOLS

[75] Inventors: Srinivasan Ramanath, Holden; Shih Yee Kuo, Westboro; William H. Williston, Holden; Sergej-Tomislav Buljan, Acton, all of Mass.

[73] Assignee: Norton Company, Worcester, Mass.

[ * ] Notice: This patent issued on a continued prosecution application filed under 37 CFR 1.53(d), and is subject to the twenty year patent term provisions of 35 U.S.C. 154(a)(2).

[21] Appl. No.: 09/049,623

[22] Filed: Mar. 27, 1998

[51] Int. Cl.[7] ..... B23F 21/03

[52] U.S. Cl. ..... 451/541; 451/527; 451/529; 451/28

[58] Field of Search ..... 451/541, 527, 451/529, 28

[56] References Cited

U.S. PATENT DOCUMENTS

| | | |
|---|---|---|
| Re. 21,165 | 7/1939 | Van der Pyl . |
| 2,238,351 | 4/1941 | Van der Pyl . |
| 2,475,517 | 7/1949 | Ries et al. . |
| 3,290,834 | 12/1966 | Lindblad . |
| 3,925,035 | 12/1975 | Keat . |
| 4,037,367 | 7/1977 | Kruse . |
| 4,184,854 | 1/1980 | Sioui et al. . |
| 4,378,233 | 3/1983 | Carver . |
| 5,385,591 | 1/1995 | Ramanath et al. . |
| 5,471,970 | 12/1995 | Sakarcan . |
| 5,505,750 | 4/1996 | Andrews . |

FOREIGN PATENT DOCUMENTS

| | | |
|---|---|---|
| 2411859 | 3/1974 | Germany . |
| 3530974 | 8/1985 | Germany . |
| 3537331 | 10/1985 | Germany . |
| 3537331 | 4/1987 | Germany . |
| 722750 | 3/1980 | U.S.S.R. . |

OTHER PUBLICATIONS

R. H. Licht, S. Ramanath, M. Simpson, E. Lilley, "Innovative Grinding Wheel Design For Cost–Effective Machining Of Advanced Ceramics", ORNL/Sub/93–SM037/1, Norton Company, Worcester, MA,Mar. 1995, pp. I–102.

G. Warnecke, J. Wimmer, "Stock Removal And Wear In Deep Grinding High–Performance Ceramics", Ceramics, IDR 3/95, pp. 126–132.

K. Subramanian, T. K. Puthanangady, S. Liu, "Diamond Abrasive Finishing Of Brittle Materials An Overview," Supertech Superabrasives Technology, 1996, World Grinding Technology Center, Norton Company, Worcester, MA, pp. Cover Sheet–25.

P. Kuo, R. H. Licht, S. Liu, M. R. Foley, D. Murphy, S. Ramanath, Subcontract 86X–SU697V; Innovative Grinding Wheel Design For Cost–Effective Machining Of Advanced Ceramics, Phase II, Norton Company, Worcester, MA, Semiannual Technical Progress Report Oct. 1996–Mar. 1997, pp. 1–27.

R. H. Licht, P. Kuo, S. Liu, D. Murphy, J. W. Picone, S. Ramanath, Subcontract 86X–SU697V; Innovative Grinding Wheel Design For Cost–Effective Machining Of Advanced Ceramics, Phase II, Norton Company, Worcester, MA, Semiannual Technical Progress Report Apr. 1997–Sep. 1997, pp. 1–23.

*Primary Examiner*—David A. Scherbel
*Assistant Examiner*—Shantese McDonald
*Attorney, Agent, or Firm*—Mary E. Porter

[57] ABSTRACT

Abrasive tools suitable for precision grinding of hard brittle materials, such as ceramics and composites comprising ceramics, at peripheral wheel speeds up to 160 meters/second are provided. The abrasive tools comprise a wheel core attached to an abrasive rim of dense, metal bonded superabrasive segments by means of a thermally stable bond.

12 Claims, 2 Drawing Sheets

ABRASIVE TOOLS

This invention relates to abrasive tools suitable for precision grinding of hard brittle materials, such as ceramics and composites comprising ceramics, at peripheral wheel speeds up to 160 meters/second. The abrasive tools comprise a wheel core or hub attached to a metal bonded superabrasive rim with a bond which is thermally stable during grinding operations. These abrasive tools grind ceramics at high material removal rates (e.g., 19–380 $cm^3$/min/cm), with less wheel wear and less workpiece damage than conventional abrasive tools.

The Government has rights in this invention pursuant to Contract No. DE-AC05-84OR21400; Subcontract No. 86X-SU697V: awarded by the U.S. Department of Energy.

BACKGROUND OF THE INVENTION

An abrasive tool suitable for grinding sapphire and other ceramic materials is disclosed in U.S. Pat. No. 5,607,489 to Li. The tool is described as containing metal clad diamond bonded in a vitrified matrix comprising 2 to 20 volume % of solid lubricant and at least 10 volume % porosity.

An abrasive tool containing diamond bonded in a metal matrix with 15 to 50 volume % of selected fillers, such as graphite, is disclosed in U.S. Pat. No. 3,925,035 to Keat. The tool is used for grinding cemented carbides.

A cutting-off wheel made with metal bonded diamond abrasive grain is disclosed in U.S. Pat. No. 2,238,351 to Van der Pyl. The bond consists of copper, iron, tin, and, optionally, nickel and the bonded abrasive grain is sintered onto a steel core, optionally with a soldering step to insure adequate adhesion. The best bond is reported to have a Rockwell B hardness of 70.

An abrasive tool containing fine diamond grain (bort) bonded in a relatively low melting temperature metal bond, such as a bronze bond, is disclosed in U.S. Pat. No. Re. 21,165. The low melting bond serves to avoid oxidation of the fine diamond grain. An abrasive rim is constructed as a single, annular abrasive segment and then attached to a central disk of aluminum or other material.

None of these abrasive tools has proven entirely satisfactory in the precision grinding of ceramic components. These tools fail to meet rigorous specifications for part shape, size and surface quality when operated at commercially feasible grinding rates. Most commercial abrasive tools recommended for use in such operations are resin or vitrified bonded superabrasive wheels designed to operate at relatively low grinding efficiencies so as to avoid surface and subsurface damage to the ceramic components. Grinding efficiencies are further reduced due to the tendency of ceramic workpieces to clog the wheel face, requiring frequent wheel dressing and truing to maintain precision forms.

As market demand has grown for precision ceramic components in products such as engines, refractory equipment and electronic devices (e.g., wafers, magnetic heads and display windows), the need has grown for improved abrasive tools for precision grinding of ceramics.

SUMMARY OF THE INVENTION

The invention is an abrasive tool comprising a core, having a minimum specific strength parameter of 2.4 MPa-$cm^3$/g, a core density of 0.5 to 8.0 g/cm3 and a circular perimeter; an abrasive rim defined by at least one abrasive segment; and a thermally stable bond between the core and the rim; wherein the abrasive segment consists essentially of superabrasive grain and a metal bond matrix having a fracture toughness of 1.0 to 6.0 MPa $M^{1/2}$; and wherein the abrasive tool is adapted for precision grinding of brittle materials at speeds up to 160 m/s. The specific strength parameter is defined as the ratio of the lesser of the yield strength or the fracture strength of the material divided by the density of the material.

DESCRIPTION OF THE PREFERRED EMBODIMENTS

Figure 1:
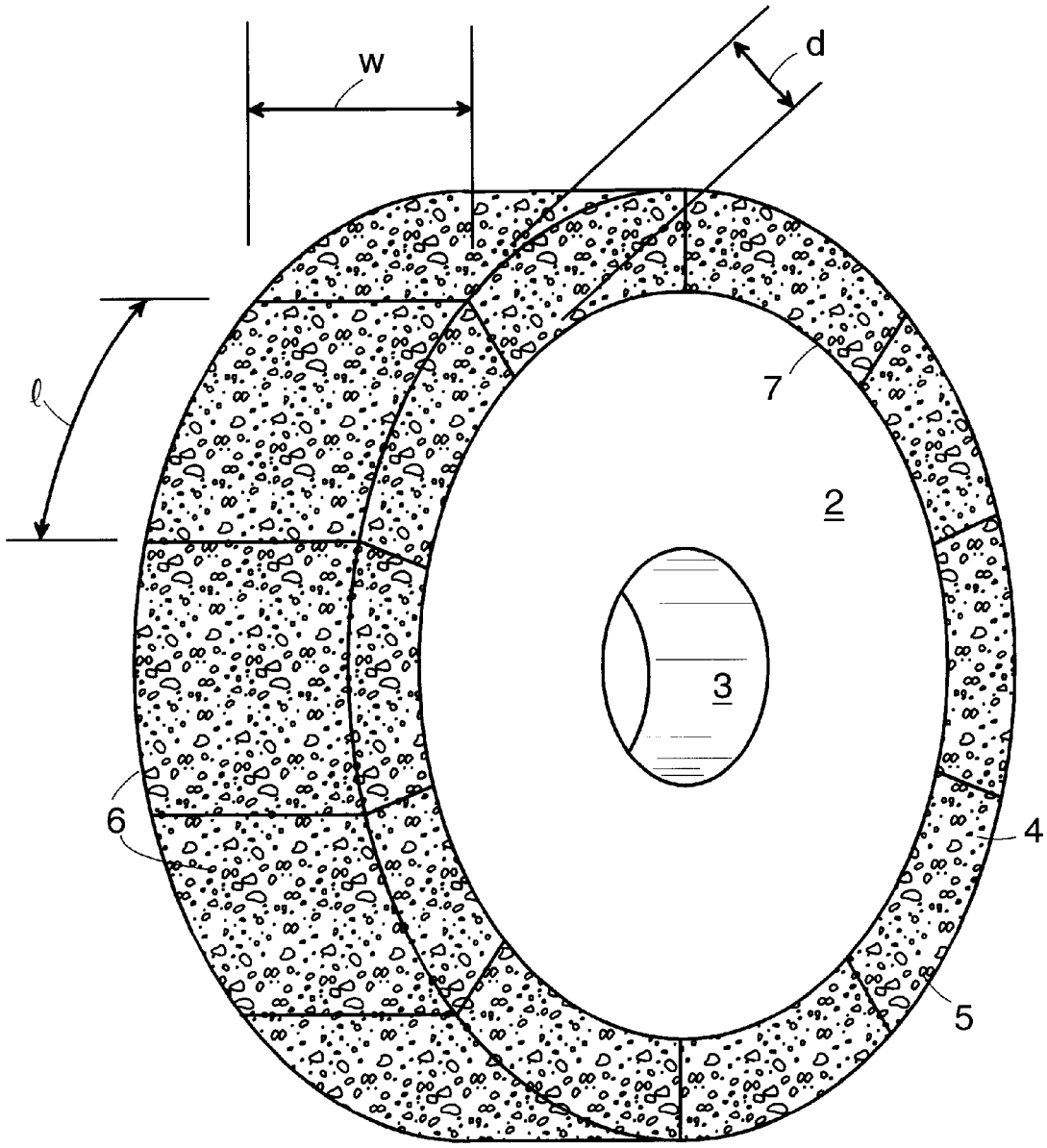
FIG. 1 illustrates a continuous rim of abrasive segments bonded to the perimeter of a metal core to form a type 1A1 abrasive grinding wheel.

The abrasive tools of the invention are grinding wheels comprising a core having a central bore for mounting the wheel on a grinding machine, the core being designed to support a metal bonded superabrasive rim along the periphery of the wheel. These two parts of the wheel are held together with a bond which is thermally stable under grinding conditions, and the wheel and its components are designed to tolerate stresses generated at wheel peripheral speeds of up to at least 80 m/sec, preferably up to 160 m/sec. Preferred tools are type 1A wheels, and cup wheels, such as type 2 or type 6 wheels or type 11V9 bell shaped cup wheels.

The core is substantially circular in shape. The core may comprise any material having a minimum specific strength of 2.4 MPa-$cm^3$/g, preferably 40–185 MPa-$cm^3$/g. The core material has a density of 0.5 to 8.0 g/$cm^3$, preferably 2.0 to 8.0 g/$cm^3$. Examples of suitable materials are steel, aluminum, titanium and bronze, and their composites and alloys and combinations thereof. Reinforced plastics having the designated minimum specific strength may be used to construct the core. Composites and reinforced core materials typically have a continuous phase of a metal or a plastic matrix, often in powder form, to which fibers or grains or particles of harder, more resilient, and/or less dense, material is added as a discontinuous phase. Examples of reinforcing materials suitable for use in the core of the tools of the invention are glass fiber, carbon fiber, aramid fiber, ceramic fiber, ceramic particles and grains, and hollow filler materials such as glass, mullite, alumina and Zeolite® spheres.

Steel and other metals having densities of 0.5 to 8.0 g/$cm^3$ may be used to make the cores for the tools of the invention. In making the cores used for high speed grinding (e.g., at least 80 m/sec), light weight metals in powder form (i.e., metals having densities of about 1.8 to 4.5 g/$cm^3$), such as aluminum, magnesium and titanium, and alloys thereof, and mixtures thereof, are preferred. Aluminum and aluminum alloys are especially preferred. Metals having sintering temperatures between 400 and 900° C., preferably 570–650° C., are selected if a co-sintering assembly process is used to make the tools. Low density filler materials may be added to reduce the weight of the core. Porous and/or hollow ceramic or glass fillers, such as glass spheres and mullite spheres are suitable materials for this purpose. Also useful are inorganic and nonmetallic fiber materials. When indicated by processing conditions, an effective amount of lubricant or other processing aids known in the metal bond and superabrasive arts may be added to the metal powder before pressing and sintering.

The tool should be strong, durable and dimensionally stable in order to withstand the potentially destructive forces generated by high speed operation. The core must have a minimum specific strength to operate grinding wheels at the very high angular velocity needed to achieve tangential contact speed between 80 and 160 m/s. The minimum specific strength parameter needed for the core materials used in this invention is 2.4 MPa-$cm^3$/g.

The specific strength parameter is defined as the ratio of core material yield (or fracture) strength divided by core material density. In the case of brittle materials, having a lower fracture strength than yield strength, the specific strength parameter is determined by using the lesser number, the fracture strength. The yield strength of a material is the minimum force applied in tension for which strain of the material increases without further increase of force. For example, ANSI 4140 steel hardened to above about 240 (Brinell scale) has a tensile strength in excess of 700 MPa. Density of this steel is about 7.8 g/cm$^3$. Thus, its specific strength parameter is about 90 MPa-cm$^3$/g. Similarly, certain aluminum alloys, for example, Al 2024, Al 7075 and Al 7178, that are heat treatable to Brinell hardness above about 100 have tensile strengths higher than about 300 MPa. Such aluminum alloys have low density of about 2.7 g/cm$^3$ and thus exhibit a specific strength parameter of more than 110 MPa-cm$^3$/g. Titanium alloys and bronze composites and alloys fabricated to have a density no greater than 8.0 g/cm$^3$, are also suitable for use.

The core material should be tough, thermally stable at temperatures reached in the grinding zone (e.g., about 50 to 200° C.), resistant to chemical reaction with coolants and lubricants used in grinding and resistant to wear by erosion due to the motion of cutting debris in the grinding zone. Although some alumina and other ceramics have acceptable failure values (i.e., in excess of 60 MPa-cm$^3$/g), they generally are too brittle and fail structurally in high speed grinding due to fracture. Hence, ceramics are not suitable for use in the tool core. Metal, especially hardened, tool quality steel, is preferred.

The abrasive segment of the grinding wheel for use with the present invention is a segmented or continuous rim mounted on a core. A segmented abrasive rim is shown in FIG. 1. The core 2 has a central bore 3 for mounting the wheel to an arbor of a power drive (not shown). The abrasive rim of the wheel comprises superabrasive grains 4 embedded (preferably in uniform concentration) in a metal matrix bond 6. A plurality of abrasive segments 8 make up the abrasive rim shown in FIG. 1. Although the illustrated embodiment shows ten segments, the number of segments is not critical. An individual abrasive segment, as shown in FIG. 1, has a truncated, rectangular ring shape (an arcurate shape) characterized by a length, l a width, w, and a depth, d.

Figure 2:
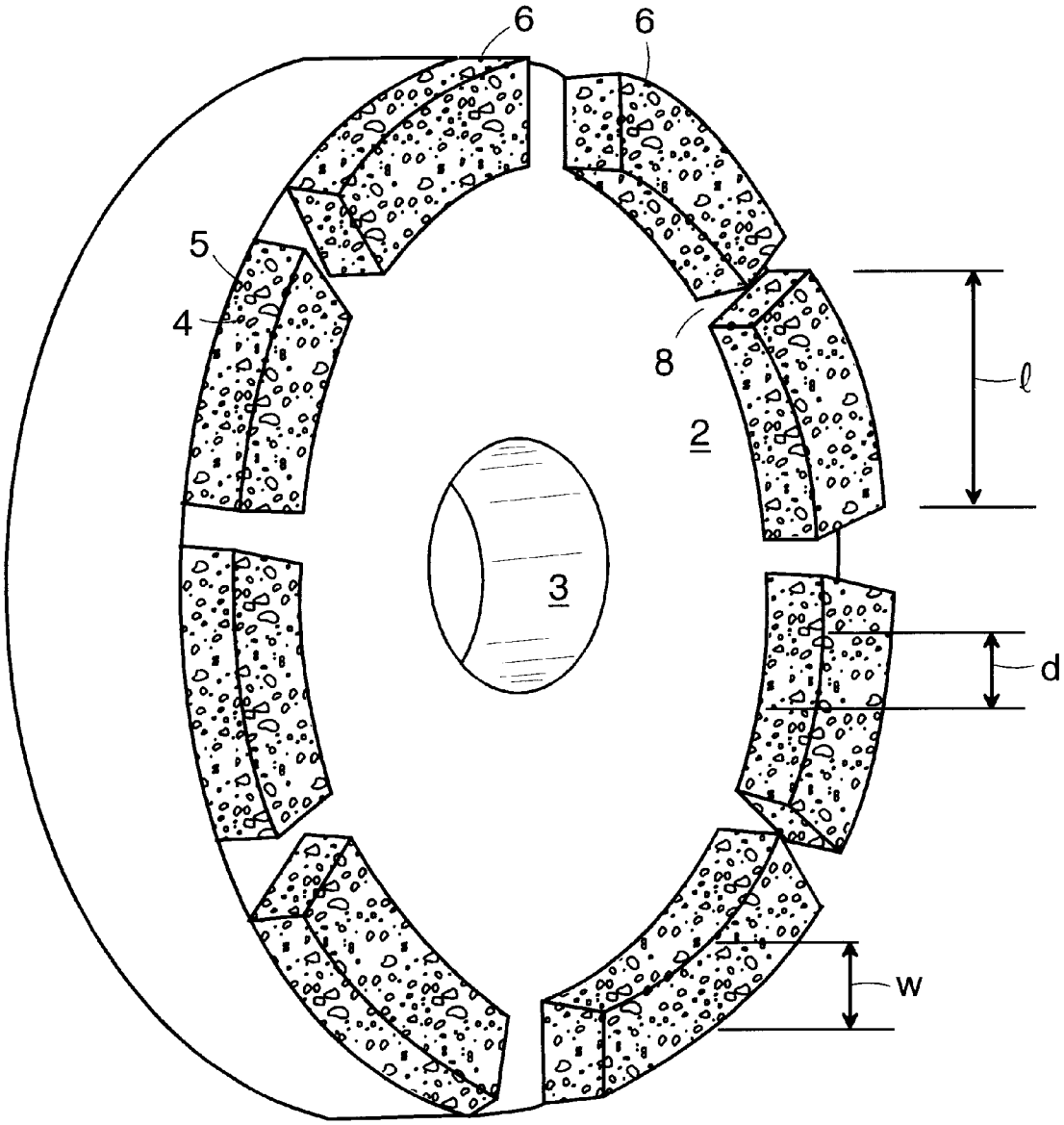
FIG. 2 illustrates a discontinuous rim of abrasive segments bonded to the perimeter of a metal core to form a cup wheel.

The embodiment of a grinding wheel shown in FIG. 1 is considered representative of wheels which may be operated successfully according to the present invention, and should not be viewed as limiting. The numerous geometric variations for segmented grinding wheels deemed suitable include cup-shaped wheels, as shown in FIG. 2, wheels with apertures through the core and/or gaps between consecutive segments, and wheels with abrasive segments of different width than the core. Apertures or gaps are sometimes used to provide paths to conduct coolant to the grinding zone and to route cutting debris away from the zone. A wider segment than the core width is occasionally employed to protect the core structure from erosion through contact with swarf material as the wheel radially penetrates the work piece.

The wheel can be fabricated by first forming individual segments of preselected dimension and then attaching the preformed segments to the circumference 9 of the core with an appropriate adhesive. Another preferred fabrication method involves forming segment precursor units of a powder mixture of abrasive grain and bond, molding the composition around the circumference of the core, and applying heat and pressure to create and attach the segments, in situ (i.e., co-sintering the core and the rim).

The abrasive rim component of the abrasive tools of the invention can be a continuous rim or a discontinuous rim, as shown in FIGS. 1 and 2, respectively. The continuous abrasive rim may comprise one abrasive segment, or at least two abrasive segments, sintered separately in molds, and then individually mounted on the core with a thermally stable bond (i.e., a bond stable at the temperatures encountered during grinding at the portion of the segments directed away from the grinding face, typically about 50–350° C.). Discontinuous abrasive rims, as shown in FIG. 2, are manufactured from at least two such segments, and the segments are separated by slots or gaps in the rim and are not mated end to end along their lengths, l as in the segmented, continuous abrasive rim wheels. The Figures illustrate preferred embodiments of the invention, and are not meant to limit the types of tool designs of the invention. Thus, discontinuous rims may be used on type 1A wheels and continuous rims may be used on cup wheels.

For high speed grinding, especially grinding of workpieces having a cylindrical shape, a continuous rim, type 1A wheel is preferred. Segmented continuous abrasive rims are preferred over a single continuous abrasive rim, molded as a single piece in a ring shape, due to the greater ease of achieving a truly round, planar shape during manufacture of a tool from multiple abrasive segments.

For lower speed grinding (e.g., 25 to 60 m/sec) operations, especially grinding of surfaces and finishing flat workpieces, discontinuous abrasive rims (e.g., the cup wheel shown in FIG. 2) are preferred.

The abrasive rim component contains superabrasive grain held in a metal matrix bond, typically formed by sintering a mixture of metal bond powder and the abrasive grain in a mold designed to yield the desired size and shape of the abrasive rim or the abrasive rim segments.

The superabrasive grain used in the abrasive rim may be selected from diamond, natural and synthetic, CBN, and combinations of these abrasives. Grain size and type selection will vary depending upon the nature of the workpiece and the type of grinding process. For example, in the grinding and polishing of sapphire, a superabrasive grain size ranging from 2 to 300 micrometers is preferred. For grinding other alumina, a superabrasive grain size of about 125 to 300 micrometers (60 to 120 grit; Norton Company grit size) is generally preferred. For grinding silicon nitride, a grain size of about 45 to 80 micrometers (200 to 400 grit), is generally preferred. Finer grit sizes are preferred for surface finishing and larger grit sizes are preferred for cylindrical, profile or inner diameter grinding operations where larger amounts of material are removed.

As a volume percentage of the abrasive rim, the tools comprise 10 to 50 volume % superabrasive grain, preferably 10 to 40 volume %. A minor amount of wear resistant material having a hardness equal to or less than that of the workpiece material, may be added as bond filler to alter the wear rate of the bond. As a volume percentage of the rim component, the filler may be used at 0–15 vol. %, preferably 0.1 to 10 vol. %, most preferably 0.1 to 5 vol. %. Tungsten carbide, cerium oxide, and alumina grain are examples of useful fillers.

Any metal bond suitable for bonding superabrasives and having a fracture toughness of 1.0 to 6.0 MPa.m$^{1/2}$, preferably 2.0 to 4.0 MPa.m$^{1/2}$, may be employed herein. Fracture toughness is the stress intensity factor at which a crack initiated in a material will propagate in the material and lead to a fracture of the material. Fracture toughness is expressed as $$K_{1c}=(\sigma_f)(\pi^{1/2})(c^{1/2}),$$

where $K_{1c}$ is the fracture toughness, $\sigma_f$ is the stress applied at fracture, and c is one-half of the crack length. There are several methods which may be used to determine fracture toughness, and each has an initial step where a crack of known dimension is generated in the test material, and then a stress load is applied until the material fractures. The stress at fracture and crack length are substituted into the equation and the fracture toughness is calculated (e.g., the fracture toughness of steel is about 30–60 $Mpa.m^{1/2}$, of alumina is about 2–3 $MPa.m^{1/2}$, of silicon nitride is about 4–5 $Mpa.m^{1/2}$, and of zirconia is about 7–9 $Mpa.m^{1/2}$).

To optimize wheel life and grinding performance, the bond wear rate should be equal to or slightly higher than the wear rate of the abrasive grain during grinding operations. Fillers, such as are mentioned above, may be added to the metal bond to decrease the wheel wear rate. Metal powders tending to form a relatively dense bond structure (i.e., less than 5 volume % porosity) are preferred to enable higher material removal rates during grinding.

Materials useful in the metal bond of the rim include, but are not limited to, bronze, copper and zinc alloys (brass), cobalt and iron, and their alloys and mixtures thereof. These metals optionally may be used with titanium or titanium hydride, or other superabrasive reactive (i.e., active bond components) material capable of forming a carbide or nitride chemical linkage between the grain and the bond at the surface of the superabrasive grain under the selected sintering conditions to strengthen the grain/bond posts. Stronger grain/bond interactions will limit premature loss of grain and workpiece damage and shortened tool life caused by premature grain loss.

In a preferred embodiment of the abrasive rim, the metal matrix comprises 45 to 90 volume % of the rim, more preferably 60 to 80 volume %. When filler is added to the bond, the filler comprises 0 to 50 volume % of the metal matrix of the rim, preferably 0.1 to 25 volume %. Porosity of the metal matrix bond should be maintained at a maximum or 25 volume %, preferably a maximum of 5 volume %, during manufacture of the abrasive segment. The metal bond preferably has a Knoop hardness of 2 to 3 GPa.

In a preferred embodiment of a type 1A grinding wheel, the core is made of aluminum and the rim contains a bronze bond made from copper and tin powders (80/20 wt. %), and, optionally with the addition of 0.1 to 3.0 wt %, preferably 0.1 to 1.0 wt %, of phosphorus in the form of a phosphorus/copper powder. During manufacture of the abrasive segments, the metal powders of this composition are mixed with 100 to 400 grit (160 to 45 microns) diamond abrasive grain, molded into abrasive rim segments and sintered or densified in the range of 400–550° C. at 20 to 33 MPa to yield a dense abrasive rim, preferably having a density of at least 95% of the theoretical density (i.e., comprising no more than about 5 volume % porosity).

In a typical co-sintering wheel manufacturing process, the metal powder of the core is poured into a steel mold and cold pressed at 80 to 200 kN (about 10–50 MPa pressure) to form a green part having a size approximately 1.2 to 1.6 times the desired final thickness of the core. The green core part is placed in a graphite mold and a mixture of the abrasive grain and the metal bond powder blend is added to the cavity between the core and the outer rim of the graphite mold. A setting ring may be used to compact the abrasive and metal bond powders to the same thickness as the core preform. The graphite mold contents are then hot pressed at 370 to 410° C. under 20 to 48 MPa of pressure for 6 to 10 minutes. As is known in the art, the temperature may be ramped up (e.g., from 25 to 410° C. for 6 minutes; held at 410° C. for 15 minutes) or increased gradually prior to applying pressure to the mold contents.

Following hot pressing, the graphite mold is stripped from the part, the part is cooled and the part is finished by conventional techniques to yield an abrasive rim having the desired dimensions and tolerances. For example, the part may be finished to size using vitrified grinding wheels on grinding machines or carbide cutters on a lathe.

When co-sintering the core and rim of the invention, little material removal is needed to put the part into its final shape. In other methods of forming a thermally stable bond between the abrasive rim and the core, machining of both the core and the rim may be needed, prior to a cementing, linking or diffusion step, to insure an adequate surface for mating and bonding of the parts.

In creating a thermally stable bond between the rim and the core utilizing segmented abrasive rims, any thermally stable adhesive having the strength to withstand peripheral wheel speeds up to 160 m/sec may be used. Thermally stable adhesives are stable to grinding process temperatures likely to be encountered at the portion of the abrasive segments directed away from the grinding face. Such temperatures typically range from about 50–350° C.

The adhesive bond should be very strong mechanically to withstand the destructive forces existing during rotation of the grinding wheel and during the grinding operation. Two-part epoxy resin cements are preferred. A preferred epoxy cement, Technodyne® HT-18 epoxy resin (obtained from Taoka Chemicals, Japan), and its modified amine hardener, may be mixed in the ratio of 100 parts resin to 19 parts hardener. Filler, such as fine silica powder, may be added at a ratio of 3.5 parts per 100 parts resin to increase cement viscosity. Segments may be mounted about the complete circumference of grinding wheel cores, or a partial circumference of the core, with the cement. The perimeter of the metal cores may be sandblasted to obtain a degree of roughness prior to attachment of the segments. The thickened epoxy cement is applied to the ends and bottom of segments which are positioned around the core substantially as shown in FIG. 1 and mechanically held in place during the cure. The epoxy cement is allowed to cure (e.g., at room temperature for 24 hours followed by 48 hours at 60° C.). Drainage of the cement during curing and movement of the segments is minimized during cure by the addition of sufficient filler to optimize the viscosity of the epoxy cement.

Adhesive bond strength may be tested by spin testing at acceleration of 45 rev/min, as is done to measure the burst speed of the wheel. The wheels need demonstrated burst ratings equivalent to at least 271 m/s tangential contact speeds to qualify for operation under currently applicable safety standards 160 m/s tangential contact speed in the United States.

The abrasive tools of the invention are particularly designed for precision grinding and finishing of brittle materials, such as advanced ceramic materials, glass, and components containing ceramic materials and ceramic composite materials. The tools of the invention are preferred for grinding ceramic materials including, but not limited to, silicon, mono- and polycrystalline oxides, carbides, borides and suicides; polycrystalline diamond; glass; and composites of ceramic in a non-ceramic matrix; and combinations thereof. Examples of typical workpiece materials include, but are not limited to, silicon nitride, silicon oxynitride, stabilized zirconia, aluminum oxide (e.g., sapphire), boron carbide, boron nitride, titanium diboride, and aluminum nitride, and composites of these ceramics, as well as certain metal matrix composites such as cemented carbides, and hard brittle amorphous materials such as mineral glass. Either single crystal ceramics or polycrystalline ceramics can be ground with these improved abrasive tools. With each type of ceramic, the quality of the ceramic part and the efficiency of the grinding operation increase as the peripheral wheel speed of the wheels of the invention is increased up to 80–160 m/s.

Among the ceramic parts improved by using the abrasive tools of the invention are ceramic engine valves and rods, pump seals, ball bearings and fittings, cutting tool inserts, wear parts, drawing dies for metal forming, refractory components, visual display windows, flat glass for windshields, doors and windows, insulators and electrical parts, and ceramic electronic components, including, but not limited to, silicon wafers, magnetic heads, and substrates.

Unless otherwise indicated, all parts and percentages in the following examples are by weight. The examples merely illustrate the invention and are not intended to limit the invention.

EXAMPLE 1

Abrasive wheels of the invention were prepared in the form of 1A1 metal bonded diamond wheels utilizing the materials and processes described below.

A blend of 43.74 wt % copper powder (Dendritic FS grade, particle size +200/−325 mesh, obtained from Sintertech International Marketing Corp., Ghent, N.Y.); 6.24 wt % phosphorus/copper powder (grade 1501, +100/−325 mesh particle size, obtained from New Jersey Zinc Company, Palmerton, Pa.); and 50.02 wt % tin powder (grade MD115, +325 mesh, 0.5% maximum, particle size, obtained from Alcan Metal Powders, Inc., Elizabeth, N.J.) was prepared. Diamond abrasive grain (320 grit size synthetic diamond obtained from General Electric, Worthington, Ohio) was added to the metal powder blend and the combination was mixed until it was uniformly blended. The mixture was placed in a graphite mold and hot pressed at 407° C. for 15 minutes at 3000 psi (2073 N/cm$^2$) until a matrix with a target density in excess of 95% of theoretical had been formed (e.g., for the #6 wheel used in Example 2: >98.5% of the theoretical density). Rockwell B hardness of the segments produced for the #6 wheel was 108. Segments contained 18.75 vol. % abrasive grain. The segments were ground to the required arcurate geometry to match the periphery of a machined aluminum core (7075 T6 aluminum, obtained from Yarde Metals, Tewksbury, Ma.), yielding a wheel with an outer diameter of about 393 mm, and segments 0.62 cm thick.

The abrasive segments and the aluminum core were assembled with a silica filled epoxy cement system (Technodyne HT-18 adhesive, obtained from Taoka Chemicals, Japan) to make grinding wheels having a continuous rim consisting of multiple abrasive segments. The contact surfaces of the core and the segments were degreased and sandblasted to insure adequate adhesion.

To characterize the maximum operating speed of this new type of wheel, full size wheels were purposely spun to destruction to determine the burst strength and rated maximum operating speed according to the Norton Company maximum operating speed test method. The table below summarizes the burst test data for typical examples of the 393-mm diameter experimental metal bonded wheels.

Experimental Metal Bond Wheel Burst Strength Data

| Wheel # | Wheel Diameter cm (inch) | Burst RPM | Burst speed (m/s) | Burst speed (sfpm) | Max. Operating Speed (m/s) |
|---|---|---|---|---|---|
| 4 | 39.24 (15.45) | 9950 | 204.4 | 40242 | 115.8 |
| 5 | 39.29 (15.47) | 8990 | 185.0 | 36415 | 104.8 |
| 7 | 39.27 (15.46) | 7820 | 160.8 | 31657 | 91.1 |
| 9 | 39.27 (15.46) | 10790 | 221.8 | 43669 | 125.7 |

According to these data, the experimental grinding wheels of this design will qualify for an operational speed up to 90 m/s (17,717 surface feet/min.). Higher operational speeds of up to 160 m/s can be readily achieved by some further modifications in fabrication processes and wheel designs.

EXAMPLE 2

Grinding Performance Evaluation

Three, 393-mm diameter, 15 mm thick, 127 mm central bore, (15.5 in×0.59 in×5 in) experimental metal bonded segmental wheels made according to the method of Example 1, above, (#4 having segments with a density of 95.6% of theoretical, #5 at 97.9% of theoretical and #6 at 98.5% of theoretical density) were tested for grinding performance. Initial testing at 32 and 80 m/s established wheel #6 as the wheel having the best grinding performance of the three, although all experimental wheels were acceptable. Testing of wheel #6 was done at three speeds: 32 m/s (6252 sfpm), 56 m/s (11,000 sfpm), and 80 m/s (15,750 sfpm). Two commercial prior art abrasive wheel recommended for grinding advanced ceramic materials served as control wheels and they were tested along with the wheels of the invention. One was a vitrified bonded diamond wheel (SD320-N6V10 wheel obtained from Norton Company, Worcester, Ma.) and the other was a resin bonded diamond wheel (SD320-R4BX619C wheel obtained from Norton Company, Worcester, Ma.). The resin wheel was tested at all three speeds. The vitrified wheel was tested at 32 m/s (6252 sfpm) only, due to speed tolerance considerations.

Over one thousand plunge grinds of 6.35 mm (0.25 inch) wide and 6.35 mm (0.25 inch) deep were performed on silicon nitride workpieces. The grinding testing conditions were:

| Grinding Test Conditions: | |
|---|---|
| Machine: | Studer Grinder Model S40 CNC |
| Wheel Specifications: | SD320-R4BX619C, SD320-N6V10, |
| Size: | 393 mm diameter, 15 mm thickness and 127 mm hole. |
| Wheel Speed: | 32, 56, and 80 m/s (6252, 11000, and 15750 sfpm) |

-continued

| Grinding Test Conditions: | |
|---|---|
| Coolant: | Inversol 22 @ 60% oil and 40% water |
| Coolant Pressure: | 270 psi (19 kg/cm$^2$) |
| Material Removal Rate: | Vary, starting at 3.2 mm$^3$/s/mm (0.3 in$^3$/min/in) |
| Work Material: | $Si_3N_4$ (rods made of NT551 silicon nitride, obtained from Norton Advanced Ceramics, Northboro, Massachusetts) 25.4 mm (1 in.) diameter × 88.9 mm (3.5 in.) long |
| Work Speed: | 0.21 m/s (42 sfpm), constant |
| Work Starting diameter: | 25.4 mm (1 inch) |
| Work finish diameter: | 6.35 mm (0.25 inch) |
| For operations requiring truing and dressing, conditions suitable for the metal bonded wheels of the invention were: | |
| Truing Operation: | |
| Wheel: | 5SG46IVS (obtained from Norton Company) |
| Wheel Size: | 152 mm diameter (6 inches) |
| Wheel Speed: | 3000 rpm; at +0.8 ratio relative to the grinding wheel |
| Lead: | 0.015 in. (0.38 mm) |
| Compensation: | 0.0002 in. |
| Dressing Operation: | |
| Stick: | 37C220H-KV (SiC) |
| Mode: | Hand Stick Dressing |

Tests were performed in a cylindrical outer diameter plunge mode in grinding the silicon nitride rods. To preserve the best stiffness of work material during grinding, the 88.9 mm (3.5 in.) samples were held in a chuck with approximately 31 mm (1¼ in.) exposed for grinding. Each set of plunge grind tests started from the far end of each rod. First, the wheel made a 6.35 mm (¼ in.) wide and 3.18 mm (⅛ in.) radial depth of plunge to complete one test. The work rpm was then re-adjusted to compensate for the loss of work speed due to reduced work diameter. Two more similar plunges were performed at the same location to reduce the work diameter from 25.4 mm (1 in.) to 6.35 mm (¼ in.). The wheel was then laterally moved 6.35 mm (¼ in.) closer to the chuck to perform next three plunges. Four lateral movements were performed on the same side of a sample to complete the twelve plunges on one end of a sample. The sample was then reversed to expose the other end for another twelve grinds. A total of 24 plunge grinds was done on each sample.

The initial comparison tests for the metal bonded wheels of the invention and the resin and vitrified wheels were conducted at 32 m/s peripheral speed at three material removal rates (MRR') from approximately 3.2 mm$^3$/s/mm (0.3 in$^3$/min/in) to approximately 10.8 mm$^3$/s/mm (1.0 in /min/in). Table 1 shows the performance differences, as depicted by G-ratios, among the three different types of wheels after twelve plunge grinds. G-ratio is the unit-less ratio of volume material removed over volume of wheel wear. The data showed that the N grade vitrified wheel had better G ratios than the R grade resin wheel at the higher material removal rates, suggesting that a softer wheel performs better in grinding a ceramic workpiece. However, the harder, experimental, metal bonded wheel (#6) was far superior to the resin wheel and the vitrified wheel at all material removal rates.

Table 1 shows the estimated G-ratios for the resin wheel and the new metal bonded wheel (#6) at all material removal rate conditions. Since there was no measurable wheel wear after twelve grinds at each material removal rate for the metal bonded wheel, a symbolic value of 0.01 mil (0.25 $\mu$m) radial wheel wear was given for each grind. This yielded the calculated G-ratio of 6051.

Although the metal bond wheel of the invention contained 75 diamond concentration (about 18.75 volume % abrasive grain in the abrasive segment), and the resin and vitrified wheels were 100 concentration and 150 concentration (25 volume % and 37.5 volume %), respectively, the wheel of the invention still exhibited superior grinding performance. At these relative grain concentrations, one would expect superior grinding performance from the control wheels containing a higher volume % of abrasive grain. Thus, these results were unexpected.

Table 1 shows the surface finish (Ra) and waviness (Wt) data measured on samples ground by the three wheels at the low test speed. The waviness value, Wt, is the maximum peak to valley height of the waviness profile. All surface finish data were measured on surfaces created by cylindrical plunge grinding without spark-out. These surfaces normally would be rougher than surfaces created by traverse grinding.

Table 1 shows the difference in grinding power consumption at various material removal rates for the three wheel types. The resin wheel had lower power consumption than the other two wheels; however, the experimental metal bonded wheel and vitrified wheel had comparable power consumption. The experimental wheel drew an acceptable amount of power for ceramic grinding operations, particularly in view of the favorable G-ratio and surface finish data observed for the wheels of the invention. In general, the wheels of the invention demonstrated power draw proportional to material removal rates.

TABLE 1

| Sample | MRR' mm 3/s/mm | Wheel Speed m/s | Tangential Force N/mm | Unit Power W/mm | Specific Energy W · s/mm 3 | G-Ratio | Surface Finish Ra μm | Waviness Wt μm |
|---|---|---|---|---|---|---|---|---|
| Resin | | | | | | | | |
| 973 | 3.2 | 32 | 0.48 | 40 | 12.8 | 585.9 | 0.52 | 0.86 |
| 1040 | 6.3 | 32 | 0.98 | 84 | 13.3 | 36.6 | 0.88 | 4.01 |
| 980 | 8.9 | 32 | 1.67 | 139 | 9.5 | 7.0 | 0.99 | 4.50 |
| 1016 | 3.2 | 56 | 0.49 | 41 | 13.1 | 586.3 | 0.39 | 1.22 |
| 1052 | 6.3 | 56 | 0.98 | 81 | 12.9 | | 0.55 | 1.52 |
| | | | | | | 293.2 | | |
| 992 | 3.2 | 80 | 0.53 | 45 | 14.2 | 586.3 | 0.42 | 1.24 |
| 1064 | 6.3 | 80 | 0.89 | 74 | 11.8 | 293.2 | 0.62 | 1.80 |
| 1004 | 9.0 | 80 | 1.32 | 110 | 12.2 | 586.3 | 0.43 | 1.75 |
| Vitrified | | | | | | | | |
| 654 | 3.2 | 32 | 1.88 | 60 | 19.2 | 67.3 | 0.7 | 2.50 |
| 666 | 9.0 | 32 | 4.77 | 153 | 17.1 | 86.5 | 1.6 | 5.8 |
| 678 | 11.2 | 32 | 4.77 | 153 | 13.6 | 38.7 | 1.7 | 11.8 |
| Metal Experimental | | | | | | | | |
| 407 | 3.2 | 32 | 2.09 | 67 | 2.1 | 6051 | 0.6 | 0.9 |
| 419 | 6.3 | 32 | 4.03 | 130 | 20.6 | 6051 | 0.6 | 0.9 |
| 431 | 9.0 | 32 | 5.52 | 177 | 19.7 | 6051 | 0.6 | 0.8 |
| 443 | 3.2 | 56 | 1.41 | 80 | 25.4 | 6051 | 0.6 | 0.7 |
| 455 | 6.3 | 56 | 2.65 | 150 | 23.9 | 6051 | 0.5 | 0.7 |
| 467 | 9.0 | 56 | 3.70 | 209 | 23.3 | 6051 | 0.5 | 0.6 |
| 479 | 3.2 | 80 | 1.04 | 85 | 26.9 | 6051 | 0.5 | 1.2 |
| 491 | 6.3 | 80 | 1.89 | 153 | 24.3 | 6051 | 0.6 | 0.8 |
| 503 | 9.0 | 80 | 2.59 | 210 | 23.4 | 6051 | 0.6 | 0.8 |

When grinding performance was measured at 80 m/s (15,750 sfpm) in an additional grinding test under the same conditions, the resin wheel and experimental metal wheel had comparable power consumption at material removal rate (MRR) of 9.0 $mm^3$/s/mm (0.8 $in^3$/min/in). As shown in Table 2, the experimental wheels were operated at increasing MRRs without loss of performance or unacceptable power loads. The metal bonded wheel power draw was roughly proportional to the MRR. The highest MRR achieved in this study was 47.3 $mm^3$/s/mm (28.4$cm^3$/min/cm).

Table 2 data are averages of twelve grinding passes. Individual power readings for each of the twelve passes remained remarkably consistent for the experimental wheel within each material removal rate. One would normally observe an increase of power as successive grinding passes are carried and the abrasive grains in the wheel begins to dull or the face of the wheel becomes loaded with workpiece material. This is often observed as the MRR is increased. However, the steady power consumption levels observed within each MRR during the twelve grinds demonstrates, unexpectedly, that the experimental wheel maintained its sharp cutting points during the entire length of the test at all MRRs.

Furthermore, during this entire test, with material removal rates ranging from 9.0 $mm^3$/s/mm (0.8 $in^3$/min/in) to 47.3 $mm^3$/s/mm (4.4 $in^3$/min/in), it was not necessary to true or dress the experimental wheel.

The total, cummulative amount of silicon nitride material ground without any evidence of wheel wear was equivalent to 271 $cm^3$ per cm (42 $in^3$ per inch) of wheel width. By contrast, the G-ratio for the 100 concentration resin wheel at 8.6 $mm^3$/s/mm (0.8 $in^3$/min/in) material removal rate was approximately 583 after twelve plunges. The experimental wheel showed no measurable wheel wear after 168 plunges at 14 different material removal rates.

Table 2 shows that the samples ground by the experimental metal bonded wheel at all 14 material removal rates maintained constant surface finishes between 0.4 μm (16 μin.) and 0.5 μm (20 μin.), and had waviness values between 1.0 μm (38 μin.) and 1.7 μm (67 μin.). The resin wheel was not tested at these high material removal rates. However, at about 8.6 $mm^3$/s/mm (0.8 $in^3$/min/in) material removal rate, the ceramic bars ground by the resin wheel had slightly better but comparable surfaces finishes (0.43 versus 0.5 μm, and poorer waviness (1.73 versus 1.18 μm).

Surprisingly, there was no apparent deterioration in surface finish when the ceramic rods were ground with the new metal bonded wheel as the material removal rate increased. This is in contrast to the commonly observed surface finish deterioration with increase cut rates for standard wheels, such as the control wheels used herein.

Overall results demonstrate that the experimental metal wheel was able to grind effectively at a MRR which was over 5 times the MRR achievable with a standard, commercially used resin bond wheel. The experimental wheel had over 10 times the G-ratio compared to the resin wheel at the lower MRRs.

TABLE 2

14 MRRs Tested At 80 m/s Wheel Speed

| Sample | MRR' mm 3/s/mm | Tangential Force N/mm | Unit Power W/mm | Specific Energy W · s/mm 3 | G-Ratio | Surface Finish Ra μm | Waviness Wt μm |
|---|---|---|---|---|---|---|---|
| Resin | | | | | | | |
| 1004 | 9.0 | 1.32 | 110 | 12.2 | 586.3 | 0.43 | 1.75 |
| Metal Invention | | | | | | | |
| 805 | 9.0 | 1.21 | 98 | 11.0 | 6051 | 0.51 | 1.19 |
| 817 | 18.0 | 2.00 | 162 | 9.0 | 6051 | 0.41 | 0.97 |
| 829 | 22.5 | 2.62 | 213 | 9.5 | 6051 | 0.44 | 1.14 |
| 841 | 24.7 | 2.81 | 228 | 9.2 | 6051 | 0.47 | 1.04 |
| 853 | 27.0 | 3.06 | 248 | 9.2 | 6051 | 0.48 | 1.09 |
| 865 | 29.2 | 3.24 | 262 | 9.0 | 6051 | 0.47 | 1.37 |
| 877 | 31.4 | 3.64 | 295 | 9.4 | 6051 | 0.47 | 1.42 |
| 889 | 33.7 | 4.01 | 325 | 9.6 | 6051 | 0.44 | 1.45 |
| 901 | 35.9 | 4.17 | 338 | 9.4 | 6051 | 0.47 | 1.70 |
| 913 | 38.2 | 4.59 | 372 | 9.7 | 6051 | 0.47 | 1.55 |
| 925 | 40.4 | 4.98 | 404 | 10.0 | 6051 | 0.46 | 1.55 |
| 937 | 42.7 | 5.05 | 409 | 9.6 | 6051 | 0.44 | 1.57 |
| 949 | 44.9 | 5.27 | 427 | 9.5 | 6051 | 0.47 | 1.65 |
| 961 | 47.2 | 5.70 | 461 | 9.8 | 6051 | 0.46 | 1.42 |

When operated at 32 m/s (6252 sfpm) and 56 m/s (11,000 sfpm) wheel speeds (Table 1), the power consumption for the metal bonded wheel was higher than that of resin wheel at all of the material removal rates tested. However, the power consumption for the metal bonded wheel became comparable or slightly less than that of resin wheel at the high wheel speed of 80 m/s (15,750 sfpm) (Tables 1 and 2). Overall, the trend showed that the power consumption decreased with increasing wheel speed when grinding at the same material removal rate for both the resin wheel and the experimental metal bonded wheel. Power consumption during grinding, much of which goes to the workpiece as heat, is less important in grinding ceramic materials than in grinding metallic materials due to the greater thermal stability of the ceramic materials. As demonstrated by the surface quality of the ceramic samples ground with the wheels of the invention, the power consumption did not detract from the finished piece and was at an acceptable level.

For the experimental metal bonded wheel G ratio was essentially constant at 6051 for all material removal rates and wheel speeds. For the resin wheel, the G-ratio decreased with increasing material removal rates at any constant wheel speed.

Table 2 shows the improvement in surface finishes and waviness on the ground samples at higher wheel speed. In addition, the samples ground by the new metal bonded wheel had the lowest measured waviness under all wheel speeds and material removal rates tested.

In these tests the metal bonded wheel demonstrated superior wheel life compared to the control wheels. In contrast to the commercial control wheels, there was no need for truing and dressing the experimental wheels during the extended grinding tests. The experimental wheel was successfully operated at wheel speeds up to 90 m/s.

EXAMPLE 3

In a subsequent grinding test of the experimental wheel (#6) at 80 m/sec under the same operating conditions as those used in the previous Example, a MRR of 380 $cm^3$/min/cm was achieved while generating a surface finish measurement (Ra) of only 0.5 μm (12 μin) and utilizing an acceptable level of power. The observed high material removal rate without surface damage to the ceramic workpiece which was attained by utilizing the tool of the invention has not been reported for any ceramic material grinding operation with any commercial abrasive wheel of any bond type.

EXAMPLE 4

A cup shaped abrasive tool was prepared and tested in the grinding of sapphire on a vertical spindle "blanchard type" machine.

A cup shaped wheel (diameter=250 mm) was made from abrasive segments identical in composition to those used in Example 1, wheel #6, except that (1) the diamond was 45 microns (U.S. Mesh 270/325) in grit size and was present in the abrasive segments at 12.5 vol. % (50 concentration), and (2) the segments sizes were 46.7 mm chord length (133.1 mm radius), 4.76 mm wide and 5.84 mm deep. These segments were bonded along the periphery of a side surface of a cup shaped steel core having a central spindle bore. The surface of the core had grooves placed along the periphery which formed discrete, shallow pockets having the same width and length dimensions as those of the segments. An epoxy cement (Technodyne HT-18 cement obtained from Taoka, Japan) was added to the pockets and the segments placed into the pockets and the adhesive was permitted to cure. The finished wheel resembled the wheel shown in FIG. 2.

The cup wheel was used successfully to grind the surface of a work material consisting of a 100 mm diameter sapphire solid cylinder yielding acceptable surface flatness under favorable grinding conditions of G-ratio, MRR and power consumption.

We claim:

1. An abrasive tool comprising a core, having a minimum specific strength of 2.4 MPa-$cm^3$/g, a core density of 0.5 to 8.0 g/cm3 and a circular perimeter; an abrasive rim defined by at least one abrasive segment; and a thermally stable bond between the core and the rim; wherein the abrasive segment consists essentially of 45 to 90 volume % metal bond matrix and 10 to 50 volume % abrasive grain sintered together at a temperature of 370–550° C., and has a fracture toughness of 1.0 to 6.0 MPa $M^{1/2}$; and wherein the abrasive tool is adapted for precision grinding of brittle materials at speeds up to 160 m/s.

2. The abrasive tool of claim 1, wherein the core comprises a metallic material selected from the group consisting of aluminum, steel, titanium and bronze, composites and alloys thereof, and combinations thereof.

3. The abrasive tool of claim 1, wherein the metal bond matrix comprises a maximum of 25 volume % porosity.

4. The abrasive tool of claim 1, wherein the metal bond matrix comprises 0.1 to 15 volume % of a wear resistant filler material.

5. The abrasive tool of claim 3, wherein the metal bond matrix comprises a maximum of 5 volume % porosity.

6. The abrasive tool of claim 1, wherein the abrasive grain is selected from the group consisting of diamond and cubic boron nitride and combinations thereof.

7. The abrasive tool of claim 1, wherein the metal bond has a Knoop hardness of 2 to 3 GPa.

8. The abrasive tool of claim 1, wherein the metal bond comprises 35 to 84 wt % copper and 16 to 65 wt % tin.

9. The abrasive tool of claim 8, wherein the metal bond further comprises 0.2 to 1.0 wt % phosphorus.

10. The abrasive tool of claim 1, wherein the abrasive tool comprises at least two abrasive segments and the abrasive segments have an elongated, arcurate shape and an inner curvature selected to mate with the circular perimeter of the core, and each abrasive segment has two ends designed to mate with adjacent abrasive segments such that the abrasive rim is continuous and substantially free of any gaps between abrasive segments when the abrasive segments are bonded to the core.

11. The abrasive tool of claim 1, wherein the tool is selected from the group consisting of type 1A1 wheels and cup wheels.

12. The abrasive tool of claim 1, wherein the thermally stable bond is selected from the group consisting essentially of an epoxy adhesive bond, a metallurgical bond, a mechanical bond and a diffusion bond, and combinations thereof.

* * * * *